US005357711A

United States Patent [19]

Trikilis

[11] Patent Number: 5,357,711

[45] Date of Patent: Oct. 25, 1994

[54] SUPPORT BAR FOR TURNSTILE ARMS

[76] Inventor: Emmanuel M. Trikilis, 1545 W. 130th St., Brunswick, Ohio 44212

[21] Appl. No.: 972,178

[22] Filed: Nov. 4, 1992

[51] Int. Cl.[5] ..... E05D 15/02

[52] U.S. Cl. ..... 49/42; 49/46

[58] Field of Search ..... 49/42, 50, 56, 38, 46; 109/11; 52/37

[56] References Cited

U.S. PATENT DOCUMENTS

| | | | |
|---|---|---|---|
| 311,781 | 2/1885 | Pierce | 49/42 |
| 1,630,200 | 5/1927 | Merrill | 49/42 |
| 1,684,578 | 9/1928 | Edwards | 49/42 |
| 1,795,621 | 3/1931 | Sprung | 49/42 |
| 2,170,192 | 8/1939 | Gersbach et al. . | |
| 2,718,039 | 9/1955 | Dube | 292/157 X |
| 3,839,825 | 10/1974 | Nica . | |
| 3,953,939 | 5/1976 | Klein | 49/56 |
| 4,358,909 | 11/1982 | Trikilis | 49/42 |
| 4,495,727 | 1/1985 | Gelinas | 49/56 |
| 4,638,596 | 1/1987 | Gallardo | 49/56 |
| 4,796,384 | 1/1989 | Warwick | 49/56 X |
| 4,989,368 | 2/1991 | Trikilis . | |
| 5,018,302 | 5/1991 | Kluge | 49/56 |

*Primary Examiner*—Michael Milano

*Attorney, Agent, or Firm*—Fay, Sharpe, Beall, Fagan, Minnich & McKee

[57] ABSTRACT

A revolving door construction includes an elongated pivot column and a plurality of spaced barrier members arranged in at least one row wherein a first end of each of the barrier members is secured to the pivot column. A support bar is spaced from the pivot column. The support bar has a plurality of longitudinally spaced transverse apertures extending therethrough such that a respective one of the barrier members extends through a respective one of the support bar apertures. Fasteners are utilized to secure the support bar to the plurality of barrier members.

17 Claims, 3 Drawing Sheets

SUPPORT BAR FOR TURNSTILE ARMS

BACKGROUND OF THE INVENTION

This invention pertains to the art of personnel access control systems. More particularly, the present invention relates to a rotary gate device which facilitates the controlled passage of people between two separated areas.

The invention is particularly applicable to a turnstile for use in controlling and/or monitoring the passage of personnel between two distinct areas such as at entrances and exits into and out of various buildings or facilities. However, it will be appreciated by those skilled in the art that the invention can readily be adapted for use in other rotary gate environments as well.

Conventionally known turnstiles have generally comprised cage-like structures having enclosure walls and rotor constructions including a vertically disposed pivot column having vertically aligned rows of barrier arms extending radially outwardly from the column. The spacing of adjacent rows of arms was sufficient for a person to pass through the turnstile as the rotor was rotated. Such turnstiles often also included a barrier column having a plurality of barrier arms.

All the barrier arms on revolving spindles or pivot columns need to be secured in place either by fasteners or by welding or the like. One problem with such arms is that vandals may successfully bend or break and detach such arms from the pivot columns. This could occur if a vandal climbs onto the arms and uses them e.g. like a ladder. While this may appear to be a minor problem with conventional barrier arms which are approximately 24 to 26 inches in length, it would be a major problem with turnstiles adapted for use by handicapped individuals such as those in wheelchairs. For those types of environments, the arms may extend up to 48 inches in length. At such a length, a lot of pressure could be brought to bear on the proximal ends of the arms at the means for fastening the arms into place on the pivot column, thereby subjecting the arms to being torn away from the columns at the fastener or weld which secures them in place.

The present invention contemplates a new and improved access control system which overcomes the above-referenced problems and others and provides a new rotary gate construction which is simple in design, economical to manufacture, light in weight and of considerable strength. The apparatus is reliable for a range of operational modes and readily adapted to a variety of applications.

BRIEF SUMMARY OF THE INVENTION

In accordance with the present invention, a new and improved revolving door construction is provided.

More particularly in accordance with the invention, the door construction comprises an elongated pivot column and a plurality of spaced barrier members arranged in at least one row wherein a first end of each of the barrier members is secured to the pivot column. A support bar is spaced from the pivot column. The support bar has a plurality of longitudinally spaced apertures extending therethrough a respective one of the barrier members extending through a respective one of the support bar apertures. A securing means is provided for securing the support bar to the plurality of barrier members.

In accordance with another aspect of the invention, a turnstile construction is provided to facilitate selective passage between two separated areas.

More particularly in accordance with this aspect of the invention, the turnstile construction comprises an elongated upstanding pivot column journaled for selective rotation about its longitudinal axis and a plurality of spaced pivot column arms each having a first end and a second end, the arms being arranged in at least one row. A first fastening means is provided for securing a first end of each of the arms to the pivot column. An elongated support bar having a plurality of longitudinally spaced apertures extending therethrough is also provided. A respective one of the arms extends through a respective one of the support bar apertures. A second fastening means is provided for securing the support bar to the plurality of arms.

In accordance with still another aspect of the invention, a reinforced turnstile construction is provided.

More particularly in accordance with this aspect of the invention, the construction comprises a pivot column and a plurality of spaced barrier members arranged in at least one row wherein the first end of each of the barrier members is secured to the pivot column. A support bar is spaced from the pivot column and has an upper end, a lower end and a plurality of longitudinally spaced apertures extending therethrough from adjacent the upper end to adjacent the lower end. A respective one of the barrier members extends through a respective one of the support bar apertures. The support bar lower end is normally spaced from an adjacent floor surface but contacts the floor surface when a downward force is exerted on at least one of the barrier arms thereby providing support for the barrier members to prevent the barrier members from becoming detached from the pivot column. A securing means secures the support bar to the plurality of barrier members.

One advantage of the present invention is the provision of a new and improved rotary gate construction.

Another advantage of the present invention is the provision of a rotary gate such as a turnstile which is reinforced to decrease the possibility of damage through vandalism by bending or even removal of the arms from the turnstile.

Still another advantage of the present invention is the provision of a turnstile construction including a pivot column and a barrier column which columns are reinforced so as to decrease the possibility that vandals could detach their arms.

Yet another advantage of the present invention is the provision of a turnstile construction which allows ready rotation of the turnstile during normal use, but which blocks, or makes more difficult, such rotation when a downward force is exerted on the turnstile arms.

A further advantage of the present invention is the provision of a turnstile construction including support bars spaced from the pivot column for reinforcing the rows of arms of the pivot column.

A yet further advantage of the present invention is the provision of a turnstile construction in which a support bar is fastened to a row of arms of the pivot column to prevent the arms from being damaged.

Still other benefits and advantages of the subject new rotary gate construction will become apparent to those skilled in the art upon a reading and understanding of this specification.

BRIEF DESCRIPTION OF THE DRAWINGS

The invention may take physical form in certain parts and arrangements of parts the preferred and alternate embodiments of which will be described in this specification and illustrated in the accompanying drawings which form a part hereof and wherein.

DETAILED DESCRIPTION OF THE PREFERRED AND ALTERNATE EMBODIMENTS

Figure 1:
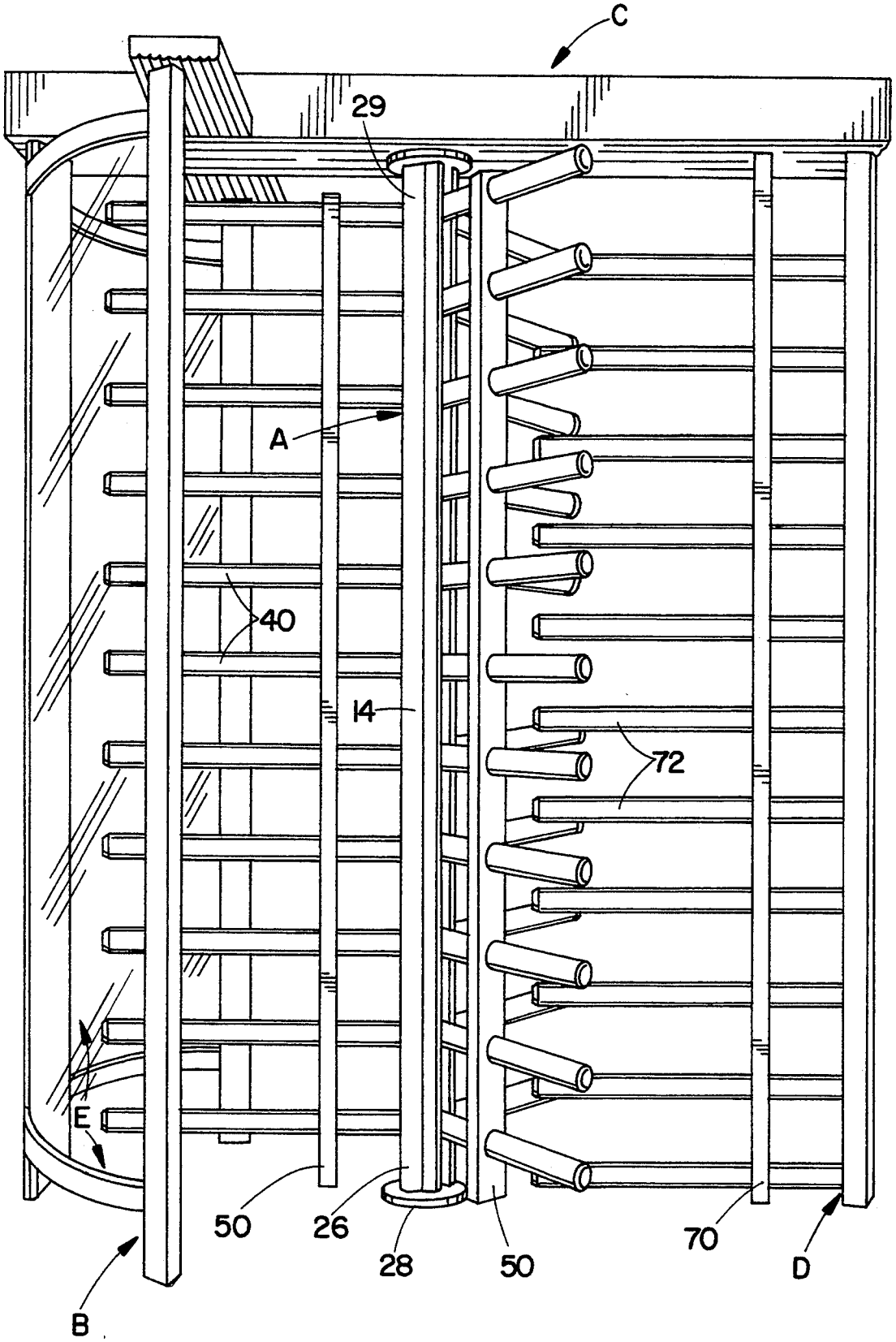
FIG. 1 is a perspective view of a turnstile constructed in accordance with the present invention.

Referring now to the drawings wherein the showings are for purposes of illustrating the preferred and alternate embodiments of the invention only and not for purposes of limiting same, FIG. 1 shows a turnstile construction comprising a turnstile rotor A, a plurality of mounting columns B, an overhead support frame C, to which the rotor and the mounting columns are secured, together with a barrier column D and a pair of cage panels E which are secured to the mounting columns B. While the rotary gate construction of the present invention will be described in connection with a specific type of turnstile installation, it will be appreciated that the overall inventive concept involved could be adapted for use in many other entry and exit control mechanisms as well.

Figure 3:
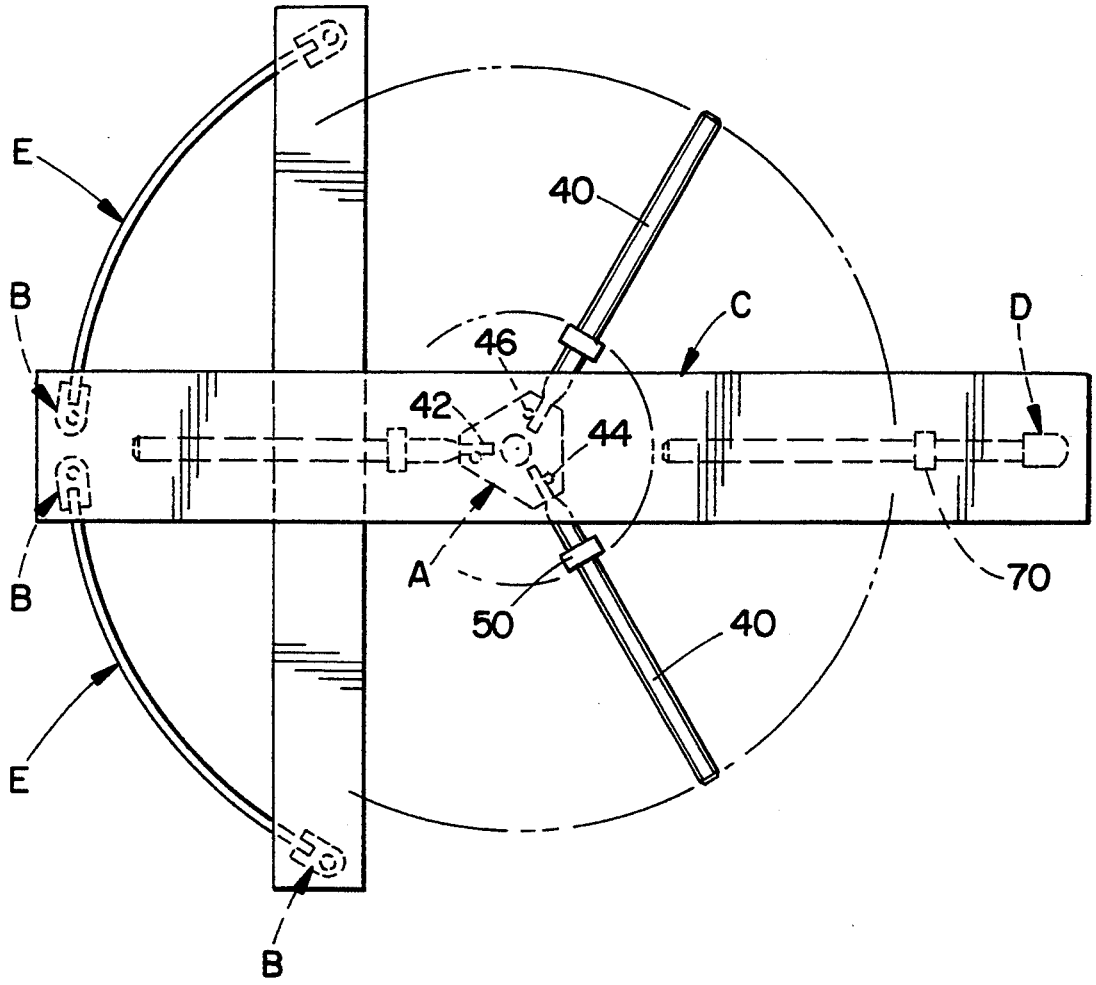
FIG. 3 is a reduced top plan view of the turnstile of FIG. 1.

With reference now to FIGS. 1 and 3, the turnstile rotor A includes a pivot column 14 which can be comprised of an elongated member extruded from aluminum or a like material. The column 14 is journaled for selective rotation about its longitudinal axis. To that end, the column includes a base end 26 mounted on a suitable bearing 28 such as a polymeric cone bearing, and an upper end 29 mounted in the overhead support frame C. The lower bearing 28 can be of a suitable conventional construction such as a male and female construction in which the male part is fixedly secured to the surface or floor area upon which the turnstile rests with the female part journally receiving the male part. In this way, the weight of the rotary column is primarily borne by the surface or floor area through the male part. Of course, other conventional mounting arrangements could also be satisfactorily employed as desired.

Secured to the pivot column are a plurality of preferably identical turnstile arms 40 extending radially outwardly therefrom. The turnstile arms 40 are aligned in a generally vertically disposed set of rows for defining a plurality of barrier planes. In the embodiment of FIGS. 1 and 3, three such barrier planes are shown. Therefore, the arc between each barrier plane is 120°. It should, however, also be appreciated that the use of e.g. a four barrier plane arm arrangement could also be employed if desired.

The inward ends of the turnstile arms 40 preferably extend into suitably shaped grooves 42 provided in the pivot column 14 as shown in FIG. 3. Extending through a longitudinally oriented bore 44 which communicates with each of the slots 42 is a suitable elongated fastener member 46, such as a rollpin or the like for securing the several barrier arms to the pivot column 14. It should be evident that other known means of securing the arms to the pivot column could also be employed.

Also provided for the turnstile construction are a plurality of support bars 50 which are fastened to the turnstile arms forming each of the barrier planes. In the embodiment of FIG. 1, four (4) such support bars 50 are provided, one for each of the three barrier planes of the turnstile rotor A and one for the plurality of arms 40 which form the barrier plane mounted to the barrier column D.

Figure 2:
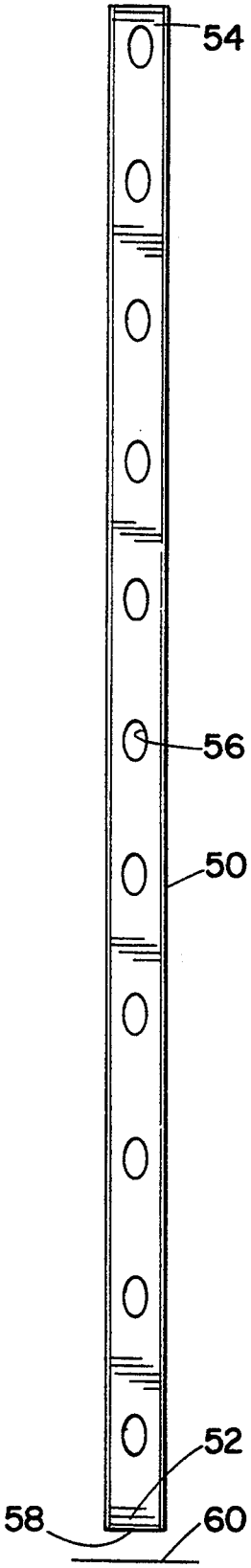
FIG. 2 is a front elevational view of a support bar according to the present invention.

With reference now to FIG. 2, the support bar 50 includes a lower end 52 and an upper end 54. Spaced along a longitudinal axis of the support bar 50 between the two ends thereof are a plurality of transversely extending apertures 56. The apertures are so spaced in the bar that a respective one of the barrier members or arms 40 can extend through a respective one of the apertures 56 as is evident from FIG. 1. The bar can be stamped from a suitable metal such as aluminum or the like. As shown in FIG. 3, the bar is spaced from the pivot column. The distance between the two can vary from a few inches to over six inches as determined by the needs of a particular turnstile construction.

In normal operation, a lower face 58 of the bar is spaced from the adjacent ground surface 60 by a few thousandths of an inch so as to allow the pivot column to rotate freely. However, when downward pressure is brought to bear on any of the arms 40, such as by someone trying to climb the arms 40 using them as a ladder, the force would be transmitted to the support bar 50. This would then descend to the ground, such that its lower face 58 would contact the ground surface 60 (the gap being greatly enlarged in FIG. 2). The support bar 50 would then act like a fulcrum to alleviate any pressure brought to bear on any individual arm 40 since the force on that arm would be dissipated over all of the arms attached to the pivot column 14.

This construction is useful even with conventional pivot column arms which are approximately 24 to 26 inches in length. However, it is particularly useful in the case of handicapped turnstiles where the pivot column arms can extend up to 48 inches in length.

Figure 4:
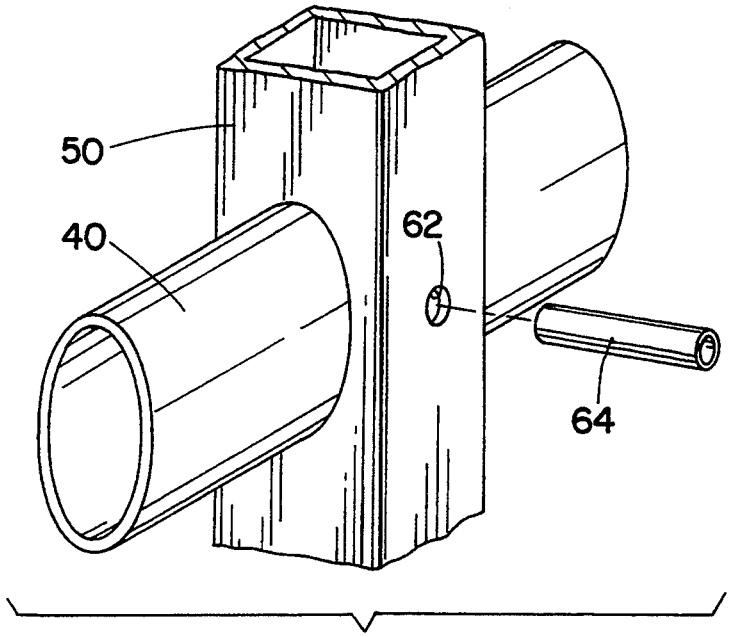
FIG. 4 is an enlarged perspective view of an arm and a support bar of FIG. 1; and, FIG. 5 is a perspective view of an arm and a support bar according to an alternate embodiment of the present invention.

FIG. 4 illustrates that a fastening means is provided to secure the several pivot column arms 40 to the support bar 50. Such a fastening means can comprise a plurality of spaced apertures 62 which are located on a side face of the support bar 50 and a plurality of fasteners 64 one of which extends through a respective one of the apertures 62. These fasteners can extend into the arms 40 which can have suitable cooperating apertures (not visible in FIG. 4) for this purpose. Such fasteners can be e.g. bolts or rollpins or the like. In the embodiment of FIG. 4, roll pins 64 are shown and the arms 40 are illustrated as being eliptical or oval in cross-section. However, it should be appreciated that other cross-sectional configurations for the arms, the fasteners and the support bar can also be provided if that is considered advantageous.

With reference now again to FIG. 1, the turnstile construction can also comprise a second support bar 70 which cooperates with a plurality of arms 72 of the barrier column D. Since the barrier column does not rotate, the support bar 70 can have a lower end which always contacts the adjacent support surface on which the barrier column D is secured, if desired. Alternatively, the support bar lower end can contact the adjacent support surface only when a downward force is exerted on one or more of the arms 72.

Figure 5:
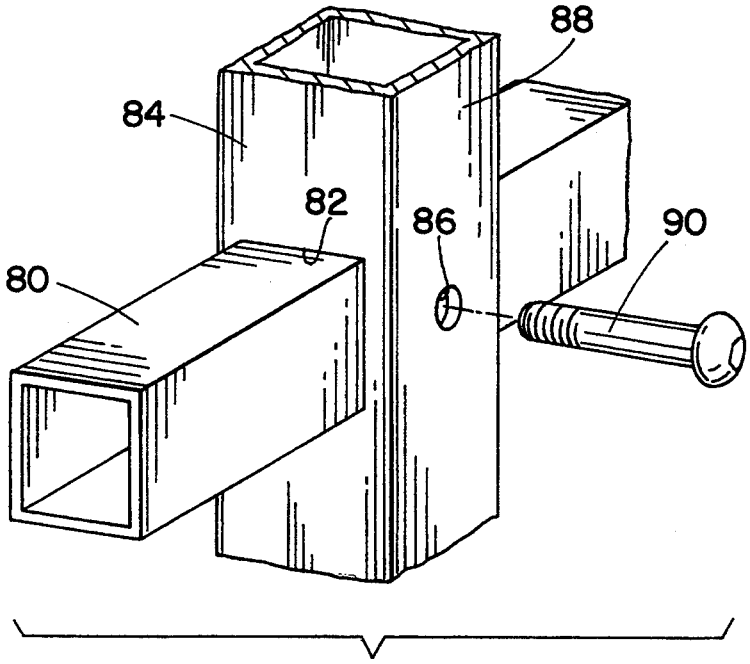

FIG. 5 illustrates an alternate embodiment of the present invention. In this embodiment, a substantially square barrier arm 80 extends through an aperture 82 of a support bar 84. Since the arm 80 is square the aperture 82 is similarly square. A bore 86 extends from an outer periphery 88 of the sidewall of the support bar 84 into the aperture 82. A suitable fastener 90 can extend through the bore 86 to secure the arm 80 to the support bar 84. While a rollpin 64 was illustrated as the fastener in FIG. 4, a bolt 90 is illustrated as the fastener used in the embodiment of FIG. 5.

It should be appreciated that the fasteners 64 and 90 can be permanently secured in place so as to permanently fasten the support bar to the arms. Preferably, however, the fasteners 64 and 90 are removeably secured in place such that the support bar 50 can be removed from the turnstile arms. This is advantageous in order to allow each of the turnstile arms to be repaired or replaced as may become necessary in normal use.

The invention has been described with reference to the preferred and alternate embodiments. Obviously, alterations and modifications will occur to others upon a reading and understanding of this specification. It is intended to include all such modifications and alterations insofar as they come within the scope of the appended claims or the equivalents thereof.

What is claimed is:

1. A revolving door construction comprising:

an elongated pivot column mounted on a subjacent floor surface;

a plurality of spaced barrier members arranged in at least one row, wherein a first end of each of said barrier members is secured to said pivot column;

a support bar spaced from said pivot column, said support bar having a plurality of longitudinally spaced apertures extending therethrough, a respective one of said barrier members extending through a respective one of said support bar apertures; and, a securing means for securing said support bar to said plurality of barrier members wherein said support bar includes a lower end which is normally spaced from said subjacent floor surface and wherein said support bar lower end contacts said floor surface when a downward force is exerted on at least one of said barrier members thereby providing support for said barrier members to prevent said barrier members from becoming detached from said pivot column.

2. The door construction of claim 1 wherein said support bar comprises an elongated substantially rectangular member.

3. The door construction of claim 1 wherein said pivot column and said support bar are substantially vertically oriented such that they are parallel to each other.

4. The door construction of claim 1 wherein said securing means comprises at least one fastener securing at least one of said barrier members to said support bar.

5. A turnstile construction adapted to facilitate selective passage between two separated areas, said turnstile construction comprising:

an elongated upstanding pivot column journaled for selective rotation about its longitudinal axis;

a plurality of spaced pivot column arms each having a first end and a second end, said arms being arranged in at least one row;

a first fastening means for securing a first end of each of said arms to said pivot column;

an elongated first support bar having a plurality of longitudinally spaced apertures extending therethrough, a respective one of said arms extending through a respective one of said first support bar apertures; and, a second fastening means for selectively securing said support bar to said plurality of arms, wherein said second fastening means comprises a plurality of selectively detachable fasteners, wherein said support bar includes a lower end which is normally spaced from an adjacent floor surface and wherein said support bar lower end contacts said floor surface when a downward force is exerted on at least one of said arms thereby providing support for said arms to prevent said arms from becoming detached from said pivot column.

6. The construction of claim 5 further comprising:

an elongated upstanding barrier column; and, a plurality of spaced barrier column arms each secured at one end to said barrier column.

7. The construction of claim 6 further comprising:

a second support bar having a plurality of longitudinally spaced apertures extending therethrough, a respective one of said barrier column arms extending through a respective one of said support bar apertures; and, a third fastening means for securing said second support bar to said plurality of mounting column arms.

8. The door construction of claim 7 wherein said third fastening means comprises several fasteners each securing one of said barrier arms to said second support bar.

9. The construction of claim 5 wherein said pivot column and said support bar are spaced from each other and are parallel to each other.

10. The door construction of claim 7 wherein said second support bar includes a lower end which is normally spaced from an adjacent floor surface and wherein said support bar lower end contacts said floor surface when a downward force is exerted on at least one of said barrier arms thereby providing support for said barrier arms to prevent said barrier arms from becoming detached from said barrier column.

11. The door construction of claim 5 wherein said fasteners each secure one of said pivot column arms to said first support bar.

12. A reenforced turnstile construction comprising:

a pivot column;

a plurality of spaced barrier members arranged in at least two rows, wherein a first end of each of said barrier members is secured to said pivot column;

a pair of support bars spaced from said pivot column one for each of said at least two rows of spaced barrier members each support bar having an upper end, a lower end and a plurality of longitudinally spaced apertures extending therethrough from adjacent said upper end to adjacent said lower end, a respective one of said barrier members extending through a respective one of said support bar apertures, wherein each said support bar lower end is normally spaced from an adjacent floor surface but contacts said floor surface when a downward force is exerted on at least one of said barrier members of a row of barrier members to which that support bar is secured thereby providing support for that row of barrier members to prevent said barrier members from becoming detached from said pivot column; and, a securing means for securing each of said support bars to said plurality of barrier members.

13. The turnstile construction of claim 12 wherein said support bars comprise elongated members and said pivot column comprises an elongated member, said support bars and said pivot column extending vertically and being spaced from each other such that they are substantially parallel to each other.

14. The turnstile construction of claim 12 wherein said securing means comprises at lest one fastener securing each of several of said barrier members to said support bar.

15. The turnstile construction of claim 12 further comprising:

an elongated upstanding barrier column; and, a plurality of spaced barrier column barrier members each secured at one end to said barrier column, said pivot column barrier members being so spaced in relation to said barrier column barrier members as to allow a rotation of said pivot column in relation to said barrier column.

16. The turnstile construction of claim 15 further comprising:

a barrier column support bar having a plurality of longitudinally spaced apertures extending therethrough, a respective one of said barrier column barrier members extending through a respective one of said barrier column support bar apertures; and, a third fastening means for securing said barrier column support bar to said plurality of barrier column barrier members.

17. The turnstile construction of claim 16 wherein said barrier column support bar has a lower end which contacts a floor surface when a downward force is exerted on said barrier column barrier members.

* * * * *